US005385205A

United States Patent [19]

Hailey

[11] Patent Number: 5,385,205

[45] Date of Patent: Jan. 31, 1995

[54] DUAL MODE ROTARY CUTTING TOOL

[76] Inventor: Charles D. Hailey, 11628 Burning Oaks, Oklahoma City, Okla. 73150

[21] Appl. No.: 131,472

[22] Filed: Oct. 4, 1993

[51] Int. Cl.[6] ..... E21B 10/32; E21B 29/06

[52] U.S. Cl. ..... 166/55.8; 175/267

[58] Field of Search ..... 166/55.8; 175/267, 269, 175/268

[56] References Cited

U.S. PATENT DOCUMENTS

| | | | |
|---|---|---|---|
| 2,180,452 | 11/1939 | Boulter | 175/267 |
| 2,482,674 | 9/1949 | Kriegel | 166/55.8 |
| 2,799,475 | 7/1957 | Harlan et al. | 175/267 |
| 2,940,522 | 6/1960 | Taylor et al. | 166/55.8 X |
| 3,528,516 | 9/1970 | Brown | 175/267 |
| 5,201,817 | 4/1993 | Hailey | 175/269 |
| 5,242,017 | 9/1993 | Hailey | 166/55.8 |

FOREIGN PATENT DOCUMENTS

| | | | |
|---|---|---|---|
| 623051 | 7/1961 | Canada | 175/267 |

*Primary Examiner*—Hoang C. Dang

*Attorney, Agent, or Firm*—Dougherty, Hessin, Beavers & Gilbert

[57] ABSTRACT

A downhole rotary cutting tool having an elongated cylindrical body with radially expanded cutting blades that are controlled by application of selected fluid as controlled from a surface source. The cutting blades have a combined abrading/jetting capability as hardened cutting surfaces are disposed at critical points of each blade and each cutting blade is ported to provide lateral jet emissions for entry into the surrounding earth medium.

11 Claims, 3 Drawing Sheets

DUAL MODE ROTARY CUTTING TOOL

BACKGROUND OF THE INVENTION

1. Field of the Invention

This invention relates generally to downhole cutting tools and clean-out methods and more particularly, but not by way of limitation, it relates to a downhole rotary cutting tool that has both a grinding and a liquid jetting capability.

2. Description of the Prior Art

The prior art has seen a number of different downhole tools of the rotary type that may be used for cutting casing, underreaming, notching formations and other downhole operations. However, Applicant is not aware of any type of rotary tool that has the capability for both an abrading rotary action and a lateral high pressure jet action such as that provided by the present invention. Such a tool is particularly useful in downhole operations where it is desired to remove a section of casing, e.g., a twenty or so foot casing section, while simultaneously removing surrounding cement or earthen formation by means of liquid jet pressure. Such a subterranean configuration is useful in adapting an existing cased borehole for accommodation of a horizontal drill string extension and continued horizontal drilling. The invention is an improvement on the downhole tool teachings of U.S. Pat. Nos. 5,201,817 and 5,242,017.

SUMMARY OF THE INVENTION

The present invention relates to improvements in downhole cutting tools which utilize an expansible cutter blade that has both (1) a hardened, abrading or cutting surface and (2) opposed liquid jets for releasing high pressure fluid from the internally channeled fluid conduits. The cutter blade actuation is effected by upward and/or downward piston force within the cutting tool, and the cutting blades have both cutting and abrading surfaces and water jet release points. Thus, the actual cutting tool is highly similar to the tool disclosed and claimed in U.S. Pat. No. 5,201,817; however, the cutting/jetting combination blades constitute another point of novelty. In addition, the internally applied actuation fluid, downcoming through the axial bore of the rotary tool and support string, is provided with yet another axial bore through the upper piston whereby the high pressure fluid is introduced into the interior channels of each of the cutting blades for subsequent release as lateral jets of cutting fluid. The cutting blades also are dressed with suitable hardened surfaces positioned for a rotary abrading or cutting motion such that the tool with combination rotary cutter is capable of cutting and milling an extended section of casing while simultaneously jet cutting the surrounding formations.

Therefore, it is an object of the present invention to provide a downhole cutting tool having a dual cutting mode.

It is also an object of the invention to provide a cutting tool that is capable of milling casing while directing jet cutters toward the surrounding matter.

It is yet further an object of the present invention to provide a rotary cutting tool that is compatible for use with various horizontal drilling configurations.

Finally, it is an object of the present invention to provide a milling and clean-out tool that is capable of more rapid operation during certain horizontal drilling practices.

Other objects and advantages of the invention will be evident from the following detailed description when read in conjunction with the accompanying drawings which illustrate the invention.

DETAILED DESCRIPTION OF THE INVENTION

Figure 1:
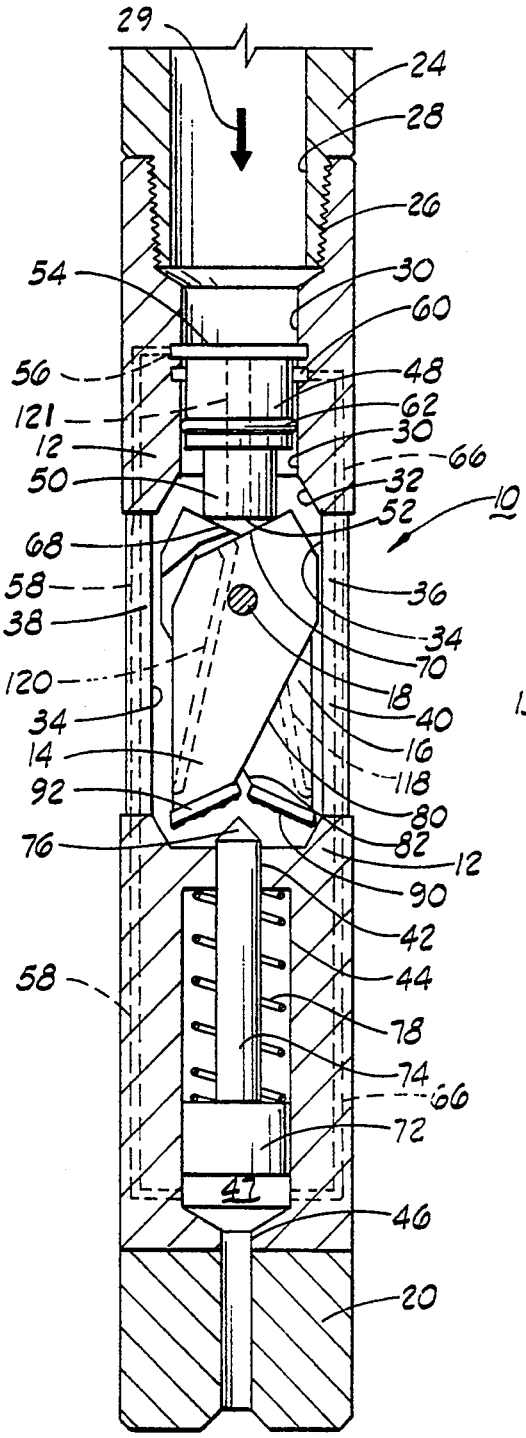
FIG. 1 is view in vertical section of a cutter tool with the cutter blades in the withdrawn position.

Referring to FIG. 1, the cutting tool 10 consists of an elongated, cylindrical body member 12 which houses the cutter blades 14 and 16 and all actuating components along an axial bore formed therein. Cutting blades 14 and 16 are pivotally retained by means of a pivot pin 18 that is threadedly engaged across body member 12. A bottom cap 20 or other sub unit may be threadedly affixed to the lower end of body member 12 as pressurized drilling fluid is able to circulate down through the entire mechanism.

A plurality of equi-spaced stabilizer elements (not shown) may be secured around the outer circumference of cutter tool 10 to maintain centering of the tool 10 within the surround of casing or the like. The cutter tool 10 is joined at the upper end by a threaded subassembly in the form of a rotational motor sub 24, a selected motor suitable for small diameter drilling systems. Such motors are available from SlimDril, Inc. of Houston, Texas. The small diameter SLIMDRIL® motors are capable of generating bit speeds from 740–1230 RPM for 1 11/16 outside diameter and in a range of 400–800 RPM at an outside diameter of 3½.

Figure 2:
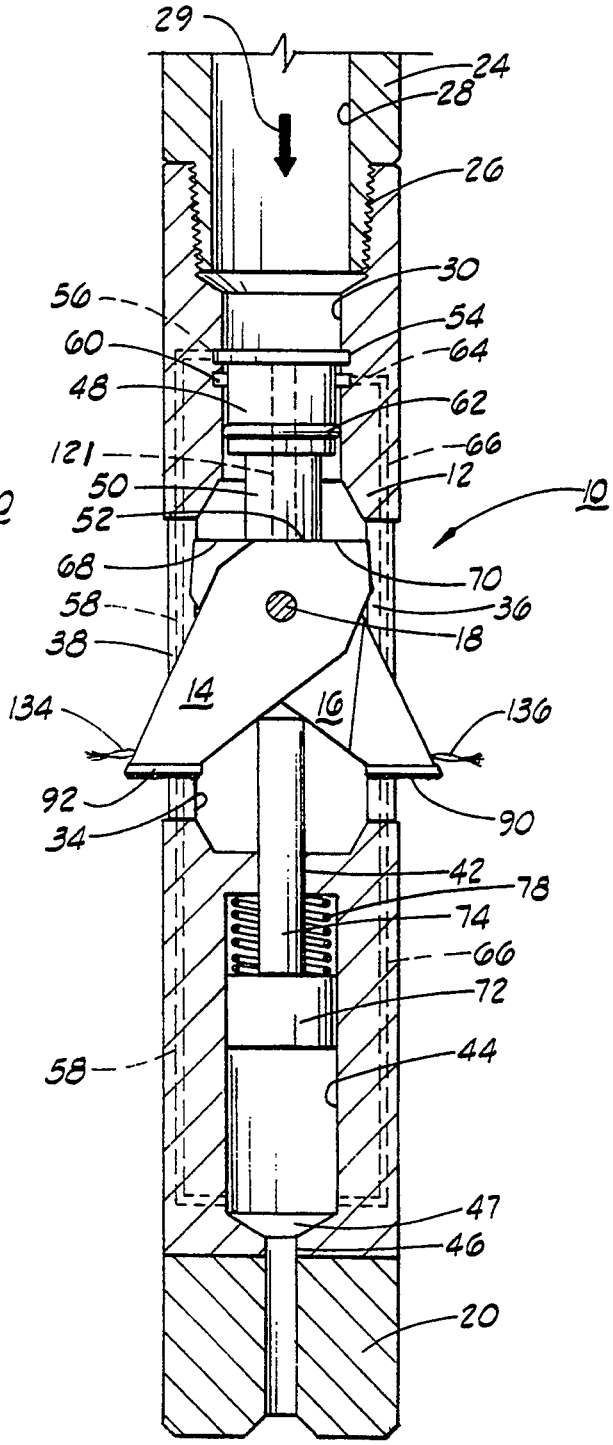
FIG. 2 is a view in vertical section of the tool of FIG. 1 with the cutter blades extended to operative position.

As shown also in FIG. 2, the body member 12 is secured on the motor sub 24 by means of threads 26. Threads 26 are standard drill string type continually engaged in response to right turning of the string. The motor sub 24 includes a central bore 28 for delivering drilling fluid 29 under pressure down to the cutting tool 10. The upper end of cutting tool 10 includes an axial bore 30 extending downward into an annular shoulder 32 which then extends into a central cavity 34 that houses the pivotally affixed cutter blades 14 and 16. A transversely extending slot 36 is formed by opposite side, vertically elongated slot ways 38 and 40 as the slot intersects with central cavity 34. The cavity 34 is formed in one dimension to accommodate the double thickness of cutter blades 14 and 16 as retained by a pivot pin 18, and in the other dimension to have sufficient width to enable cutter blades 14 and 16 to be expanded completely outboard through slotways 38 and 40 into operational configuration as shown in FIG. 2.

The lower end of body member 12 is formed with a first axial bore 42 in communication with central cavity 34 and expanding outward into a lower bore 44 that extends downward and is funneled into drilling fluid passage 46. A volume 47 constitutes a lower cylinder that houses a lower piston assembly, as will be further described below.

A first actuating assembly consists of an upper piston 48 having a rod end 50 disposed for reciprocation within the axial cylinder bore 30. The rod end 50 includes a circular foot end 52 which functions to engage and depress the cutter blades 14 and 16 during actuation, as shown in FIG. 2. An upper annular groove 54 is formed around bore 30 in communication with a plurality of ports 56 which lead to by-pass ports 58 that extend downward around the cutter mechanism. The number of by-pass ports 58 utilized may vary with design considerations for cutting tool 10.

As illustrated in FIG. 1, the inoperative or deactivated position, the upper surface of piston 48 rests adjacent the lower wall of annular groove 54 so that there is normally open fluid flow from the bore 28 downward through annular groove 54 and ports 56 to by-pass ports 58 and on to the lower volume 47 and outlet fluid passage 46. A second annular groove 60 is formed around axial bore 30 at a position where it is normally blocked by the sidewalls of piston 48, and further sealing is provided by a seated elastomer O-ring 62. The annular groove 60 also communicates via ports 64 and by-pass ports 66 down to the lower volume 47 and outlet fluid passage 46. Noting also FIG. 2, it is apparent that sufficient fluid pressure 29 in bore 28 forces piston 48 downward and beneath the position of second annular groove 60 thereby allowing additional pressurized fluid flow through the respective ports 64 and by-pass ports 66. Also, the downward movement of piston 48 places rod end 50 and foot pad 52 in activating contact with respective upper angle ends 68 and 70 of cutter blades 14 and 16 thereby to expand the blades outboard through respective slot ways 38 and 40 and into operational position, as shown in FIG. 2.

Simultaneous with downward actuation of upper piston 48, the fluid pressure build-up in lower bore volume 47 via by-pass ports 58 and 66 will cause actuation of a lower piston 72 sliding upward within cylinder bore 44 thereby to extend an elongated rod end 74 having angled pad end 76 upward against the bias of a coil spring 78. Thus, the elongated rod end 74 is moved upward through narrower bore 42 such that pad end 76 engages the lower edges 80 and 82 of respective cutter blades 14 and 16 thereby to force the cutter blades open as well as to continually brace the cutter blades against any opposing force.

The cutter blades 14 and 16 constitute a pair of blades in combination wherein each has an abrading as well as a jet cutting capability. The respective cutter blades 14 and 16 have lower edges 80 and 82 as well as respective upper angle ends 68 and 70. Referring to FIGS. 3–7, each of cutter blades 14 and 16 includes, respectively, the lower acute angle edges 80 and 82 as well as the opposite outer edges 84 and 86 which secure a foot pad 88 and 90 therebetween, respectively. The foot pads 88 and 90 may be preformed from a selected hardened steel alloy and inset with rows of natural diamond 92 and 94 as foot pads 88 and 90 are secured as by welding into abrading position on the bottom of respective blades 14 and 16. Alternatives to the diamond inlay cutting configurations may be used, e.g., tungsten carbide surfaces such as KUTRITE® inserts and/or thermally stable polycrystalline diamond materials as held within suitable matrices.

Each of blades 14 and 16 has an upper corner block 96 and 98, respectively, which are formed for locking abutment against respective upper blade corners 100 and 102 that are formed as extensions of respective outer edges 84 and 86. Pivot holes 104 are formed generally centrally through the upper portion of each of cutter blades 14 and 16 as they are pivotally supported on pivot pin 18 (see FIG. 1). Lower stop blocks 106 and 108, respectively, are also formed on the cutter blades 14 and 16 both to broaden the support surface for receiving respective foot pads 88 and 90 and to provide a stop engagement at the upper portions against respective diagonal edges 110 and 112.

Figure 3:
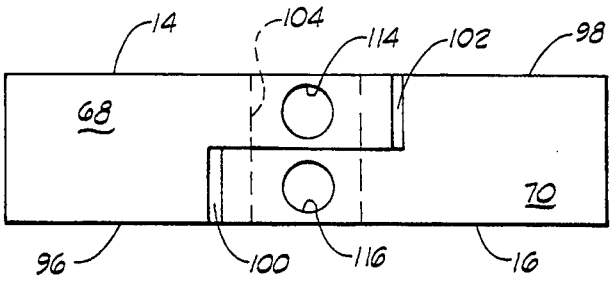
FIG. 3 is a top plan view of the cutter blades of FIG. 2 when in the expanded position.
Figure 4:
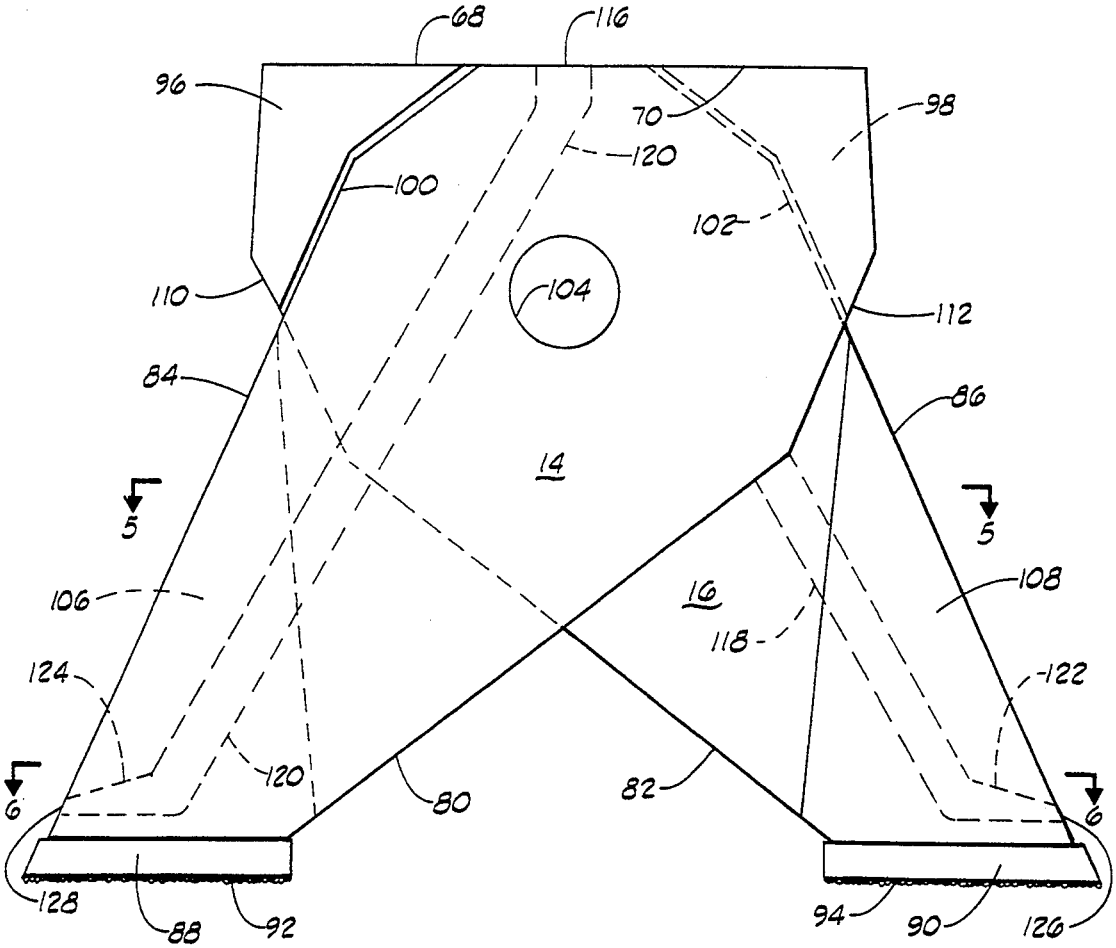
FIG. 4 is a view in vertical elevation of the cutter blades of FIG. 2.

Referring particularly to FIGS. 3 and 4, the cutter blades 14 and 16 are shaped for scissors-like coaction as they pivot about pivot pin 18 (FIG. 1). They are each constituted of a continuous half thickness throughout the area of the respective cutter blades 14 and 16 with only upper corner blocks 96, 98 and lower corner blocks 106, 108 constituting the remaining half thickness. Thus, the continuous half thickness portions of cutter blades 14 and 16 are formed to include respective upper orifices 114 and 116 which lead into respective downward bores 118 and 120 which communicate for fluid input with the axial bore 121 of the piston 48 and rod end 50 (see FIGS. 1 and 2). The lower end of respective bores 118 and 120 then communicate internally with respective conical bores 122 and 124. Thus, high pressure fluid 29 flowing downward communicates through axial bore 121 of piston 48 and rod end 50 when the blades 14 and 16 are in operational position as in FIG. 2. The high pressure fluid 29 is then able to flow via cutter blade upper orifices 114 and 116 (see FIGS. 3 and 4) and respective ports 118 and 120 to provide a lateral jet stream from each of orifices 126 and 128.

Figure 5:
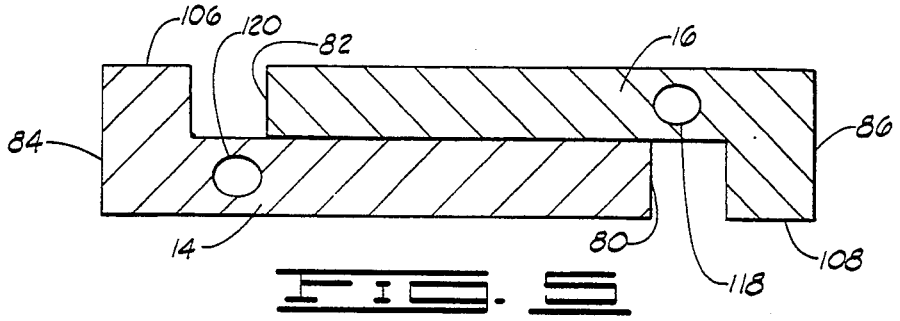
FIG. 5 is a section taken along lines 5—5 of FIG. 4.
Figure 6:
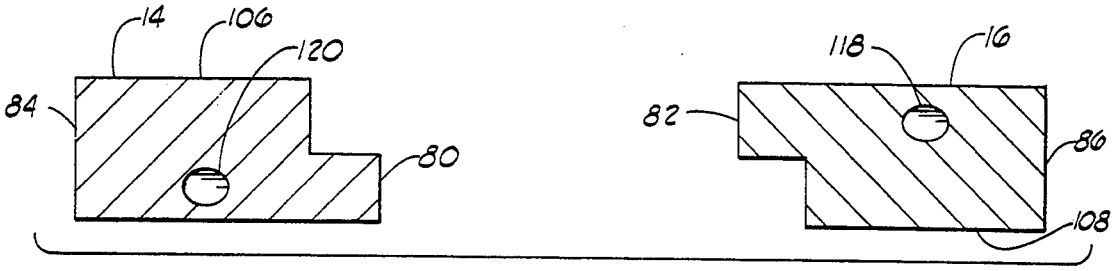
FIG. 6 is a section taken along lines 6—6 of FIG. 4.
Figure 7:
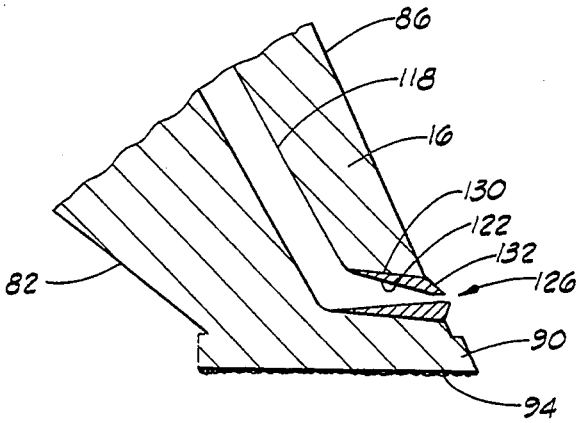
FIG. 7 is a view in vertical cross section of the lower portion of a single cutter blade.

FIG. 5 illustrates the manner in which the vertical bores 118 and 120 are formed down through the continuous half thicknesses of the respective cutter blades 14 and 16. FIG. 6 shows a continuation in progression of the downwardly directed bores 118 and 120, and FIG. 7 illustrates in vertical section for the cutter blade 16 (cutter blade 14 being formed identically) the manner in which vertical bore 118 is directed into a laterally directed conical bore 122 which then emits a high pressure jet stream from the orifice 126. It should be noted too, that as a practical matter, an alternative structure for the orifice 126 may be preferred. That is, a generally lateral bore 130 may be formed in communication with the vertical bore 118; thereafter, a nozzle insert 132 formed from a hardened steel alloy may be secured therein to provide the conical bore and orifice that is more free from jet wear and more secure in long term usage.

In operation, the cutting tool 10 with the jet/abrading cutter blades 14 and 16 are particularly useful in applications where it is desired to provide a lateral bend in a drill string for purposes of longitudinal drilling. Thus, the cutter tool 10 may be run down an existing or newly drilled borehole to the desired depth whereupon operation requires that a number of feet, e.g., 20 to 30 feet, of the casing be removed and that lateral space be widened to permit proper longitudinal drill string orientation. Cutting tool 10 can then be made operational with outboard locking of cutter blades 14 and 16 to cut through the existing casing surrounding cutter tool 10. After cutting through the casing, the cutter tool 10 is spread as in FIG. 2 so that downward pressure can be exerted on the cutter foot pads 90 and 92 and the rotation acts to grind down the casing. During the process of grinding down the casing, which may continue until 20 or 30 feet of casing is removed, the drilling fluid 29 is applied through the respective ports 120 and 118 of cutter blades 14 and 16 to emit the fluid jets 134 and 136. The drilling jets 134 and 136 are directed at sharp focus and very high pressure into the surrounding cement and/or earthen formation to remove material and form a concentric cavity around the vacant portion of the casing. The cavity is formed long enough and having sufficient diameter to enable right angle bending of the drilling tool string thereby to commence horizontal drill progression.

The foregoing discloses a novel cutter blade combination for use in rotary cutting tools that are employed in preparing a vertical borehole to enable lateral orientation of a horizontal drilling tool. The cutter blades employ both an abrading cutter surface for separating casing and grinding away casing while also including a high pressure jet fluid drilling element for removing any surrounding cement and/or earthen formation to a predetermined diameter surrounding the casing. The cutter tool and combination cutter blades of the present invention provide a rotary element that enables certain horizontal drilling preparation with much increased speed and greater control by the surface operator.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A downhole rotary cutting tool, comprising:

an elongate body member having upper and lower ends and including a slot defined laterally therethrough;

a source of high pressure fluid applied to the elongate body member upper end;

a cutting assembly pivotally retained within said body member slot, said cutting assembly including a top edge and internal port communicating between the top edge and a generally laterally directed jet orifice; and first piston means having an axial port and being disposed above said cutting assembly and actuatable to contact said top edge and force said cutting assembly radially outward into operative position while directing high pressure fluid down through said axial port and into the cutting assembly internal port to energize said jet orifice in a lateral direction.

2. A rotary cutting tool as set forth in claim 1 which is further characterized to include:

second piston means disposed below said cutting assembly and actuatable simultaneously with said first piston means actuation to reinforce said cutting assembly radially outward to the operative position.

3. A rotary cutting tool as set forth in claim 1 wherein said cutting assembly comprises:

first and second cutter blades each having a top edge and an internal port and being aligned in side by side disposition for opposite pivotal movement, the first blade having a first abrading foot pad and an adjacent jet orifice, the second blade having a second abrading foot pad and an adjacent jet orifice.

4. A rotary cutting tool as set forth in claim 3 wherein each of said first and second cutter blades includes:

a pivot hole disposed centrally toward the upper extremity and having an uppermost angle edge that is disposed perpendicular to the elongate body vertical axis when in the operative position with said respective foot pad secured at the bottom in a plane perpendicular to said elongate body vertical axis; and hardened cutting material embedded in said foot pad.

5. A rotary cutting tool as set forth in claim 1 wherein:

said internal port is a bore extending from the top edge of said cutting assembly downward to said lateral jet orifice.

6. A rotary cutting tool as set forth in claim 4 which is further characterized to include:

second piston means disposed below said cutting assembly and actuatable simultaneously with said first piston means actuation to reinforce said cutting assembly radially outward to the operative position.

7. A downhole rotary cutting tool with dual cutting capability comprising:

an elongated body member having a slot defined laterally therethrough and further including an elongated cavity having upper and lower ends communicating centrally with said slot;

a source of drilling fluid under pressure input to said body member;

first and second cutting members each having an upper angle edge and lower edges and being pivotally mounted in opposed orientation in said slot, each of said cutting members having a respective first and second port extending from the respective upper angle edge to the lower edge;

first and second laterally oriented jet orifices disposed at lower edges of said first and second cutting members in communication with the respective first and second ports; and first piston means disposed in said elongated cavity adjacent said angle edges of the first and second cutting members, said piston means having an axial bore formed therethrough;

whereby the applying of fluid under pressure at body member upper end depresses the first piston means against the upper angle edges to force the opposed cutting members laterally into operative position while also applying drilling fluid under pressure down through said axial bore and first and second vertical ports to the first and second jet orifices to produce lateral fluid jets.

8. A downhole rotary cutting tool as set forth in claim 7 which further includes:

a second piston means disposed in said cavity lower end and including an upwardly oriented rod end for contact with the lower edges of the first and second cutting members;

by-pass port means conducting the fluid under pressure from the body member upper end down to cavity lower end to increase fluid pressure and force the second piston means rod end upward against the first and second cutting members thereby to reinforce the radial extension in operative position.

9. A downhole rotary cutting tool as set forth in claim 8 which is further characterized to include:

spring means normally urging said second piston means away from said first and second cutting members,

10. A downhole rotary cutting tool as set forth in claim 7 wherein said first and second cutting members each comprise:

a planar body having an upper angled edge for contacting the first piston means, an outer edge and inner edge extending to a foot pad that is secured generally parallel to said upper angled edge;

hardened cutting material embedded in said foot pad; and a pivot hole through said planar body proximate the upper angled edge.

11. In a rotary tubing tool of the type having opposed pairs of pivotally affixed cutting blades that are radially expandable into the Operative position, a pair of cutting blades wherein each blade comprises:

a planar body having an upper angle edge which extends on one side into an outer edge and on the remaining side into a lower edge with a foot pad secured on the bottom between the outer edge and lower edge;

a pivot hole through said planar body at a point generally central and about one-fourth of the distance down from said upper angle edge;

a hardened abrading surface embedded in said foot pad; and a port extending from the upper angle edge down through said planar body to a jet orifice adjacent said foot pad for conducting fluid laterally under pressure when the planar body is radially expanded to the operational position.

* * * * *